US007033193B2

(12) United States Patent
Higgins et al.

(10) Patent No.: US 7,033,193 B2
(45) Date of Patent: Apr. 25, 2006

(54) MULTI-ENVIRONMENT IN-LINE CONNECTOR

(76) Inventors: Sidney A. Higgins, c/o Itron, Inc., 2818 North Sullivan Rd., Spokane, WA (US) 99215; Gary Lust, c/o Itron, Inc., 2818 North Sullivan Rd., Spokane, WA (US) 99215; Loren Dietz, c/o Itron, Inc., 2818 North Sullivan Rd., Spokane, WA (US) 99215; Kenneth C. Rigdon, c/o Itron, Inc., 2818 North Sullivan Rd., Spokane, WA (US) 99215; Jeffrey H. Hintz, c/o Viking Electronics, Inc., 5455 Endeavour Crt., Moorpark, CA (US) 93021-8009; Charles S. Underhill, c/o Viking Electronics, Inc., 5455 Endeavour Crt., Moorpark, CA (US) 93021-8009; Kent B. Hambly, c/o Viking Electronics, Inc., 5455 Endeavour Crt., Moorpark, CA (US) 93021-8009

( * ) Notice: Subject to any disclaimer, the term of this patent is extended or adjusted under 35 U.S.C. 154(b) by 0 days.

(21) Appl. No.: 11/007,657

(22) Filed: Dec. 8, 2004

(65) Prior Publication Data

US 2005/0266714 A1 Dec. 1, 2005

Related U.S. Application Data

(60) Provisional application No. 60/528,019, filed on Dec. 9, 2003.

(51) Int. Cl.
*H01R 13/52* (2006.01)

(52) U.S. Cl. ..... 439/277; 439/321

(58) Field of Classification Search ..... 439/277, 439/321, 320, 322, 323, 359, 362–365
See application file for complete search history.

(56) References Cited

U.S. PATENT DOCUMENTS

| | | | | |
|---|---|---|---|---|
| 3,124,405 | A | | 3/1964 | Massa |
| 3,643,208 | A | | 2/1972 | Massa, Jr. |
| 3,719,918 | A | | 3/1973 | Kerr |
| 4,220,808 | A | | 9/1980 | Fujita |
| 4,433,206 | A | | 2/1984 | Lewis |
| 4,486,062 | A | | 12/1984 | Kasugai |
| 4,526,431 | A | | 7/1985 | Kasukawa |
| 4,540,230 | A | * | 9/1985 | Iversen et al. ..... 439/277 |
| 4,629,272 | A | | 12/1986 | Mattingly et al. |
| 4,702,710 | A | | 10/1987 | Dittman et al. |
| 4,762,504 | A | | 8/1988 | Michaels et al. |
| 4,874,324 | A | | 10/1989 | Andersen et al. |
| 5,067,909 | A | | 11/1991 | Behning |

(Continued)

*Primary Examiner*—Ross Gushi
(74) *Attorney, Agent, or Firm*—Patterson, Thuente, Skaar & Christensen, P.A.

(57) ABSTRACT

An electrical connector assembly for use in environmentally challenging locations. The electrical connector assembly comprises a receptacle connector member, a plug connector member and a coupling nut that interface to provide dual radial seals so as to define dual contaminant barriers. The dual radial seals substantially eliminate the possibility of particulate as well as moisture and water intrusion. Each connector member is individually potted to a wire to eliminate the potential for water wicking up the wire while transferring the wire pull strength to the connector member. The electrical connector can include a security seal to provide visual indication of any tampering with the electrical connector assembly. Each connector member can include a protective cover allowing the connector members to be stored for extended periods of time without degradation.

14 Claims, 11 Drawing Sheets

U.S. PATENT DOCUMENTS 5,199,893 A * 4/1993 Fussell ..... 439/271
5,387,129 A 2/1995 Hotea
5,470,248 A 11/1995 Wood
5,564,938 A 10/1996 Shenkal et al.
5,567,174 A 10/1996 Ericson, Jr. et al.
5,580,282 A 12/1996 Paterek
5,662,488 A 9/1997 Alden
5,825,303 A 10/1998 Bloss, Jr. et al.
5,877,703 A 3/1999 Bloss, Jr. et al.
6,010,348 A 1/2000 Alden
6,162,082 A 12/2000 Karsten et al.
2004/0038578 A1* 2/2004 Weigel et al. ..... 439/320

* cited by examiner

MULTI-ENVIRONMENT IN-LINE CONNECTOR

PRIORITY CLAIM

The present invention claims priority to U.S. Provisional Application Ser. No. 60/528,019, filed Dec. 9, 2003, entitled "Multi-Environment In-Line Connector", and hereby incorporated by reference in its entirety.

FIELD OF THE INVENTION

The invention relates to an electrical connector. More particularly, the invention describes an electrical connector incorporating protective features allowing the connector to function reliably for long periods of time under a wide range of environmental conditions.

BACKGROUND OF THE INVENTION

A variety of electrical connector designs are available for use in electrically connecting components, for example sensors with transmitters. Depending upon the particular application, a user selects the appropriate connector based on any number of application-specific factors, for example, code requirements, exposure to specific environmental conditions and anticipated lifespan, to name a few.

An especially challenging environment for using electrical connectors is with water meters and transmitters that are located in below ground water pits. Such water pit installations are commonly used in geographic regions that are not typically subjected to freezing conditions and in which a majority of homes are generally not constructed on full slab foundations. As such, there is no basement or access space for mounting a water meter within the home.

Due to the nature of the application, electrical connectors used within water pits must be capable of resisting long term exposure to an environment ranging from high humidity to full submersion. In addition, the constraints associated with accessing and working within a water pit requires that the electrical connector be easy to assemble and install.

One known connector currently used in these types of environments is disclosed in U.S. Pat. No. 6,162,082 to Karsten et al., which is herein incorporated by reference to the extent not inconsistent with the present disclosure. While the Karsten et al. patent teaches an electrical connector for used in "wet" environments, the electrical connector suffers from the disadvantage of being permanently connected when assembled such that disassembly requires the use of a tool to fracture a locking component of the electrical connector. This locking component must then be replaced with a new locking component in order to complete the connection.

SUMMARY OF THE INVENTION

The electrical connector assembly of the invention includes features promoting both long-term reliability as well as ease of installation and maintenance. The electrical connector of the invention comprises a receptacle connector member and a plug connector member that interface to provide a dual radial seal substantially eliminating the possibility of moisture and water intrusion. Each connector member is individually potted to a wire to substantially eliminate the potential for water wicking up the wire while transferring the wire pull strength to the connector member. The receptacle connector member and plug connector member are retainably joined with a rotatably disassemblable locking member allowing for easy maintenance and reuse without the use of any tools. When connected, the electrical connector comprises dual radial seals, one to prevent dirt and contaminant infiltration, the second prevention moisture/water intrusion. The electrical connector can further comprise a security seal member to prevent and/or indicate unauthorized tampering with the electrical connector. The security seal member performs no joining or sealing function such that its size, shape and orientation can be varied so as to be economically provided without having any effect on the functionality of the electrical connector. Both the receptacle connector member and the plug connector member can further include individual protective covers allowing them to be maintained and stored for extended periods of time without degradation.

In one representative embodiment, the electrical connector of the invention can be used to electrically connect a water meter with a transmitter in a water pit installation, however the invention is not necessarily limited to such an application. In general, the electrical connector of the invention can be employed in conditions, ranging from high humidity to full submersion, in which a reliable connection is required between disparate electrical components.

In one aspect, the electrical connector of the invention comprises an improved seal design over presently available electrical connectors so as to substantially eliminate the possibility of moisture/water intrusion into the connector.

In another aspect, the electrical connector of the invention comprises alignment features that substantially eliminate the possibility of misassembling the electrical connector.

In another aspect, the electrical connector of the invention comprises assembly features allowing the electrical connector to be implemented and installed without requiring custom tools or specialized skills on the part of the installer.

In another aspect, the electrical connector of the invention comprises assembly features allowing the electrical connector to be factory installed to electrical devices such that field installation time is reduced.

In another aspect, the electrical connector of the invention comprises protective features allowing unassembled portions of the connector to be protected from moisture and water intrusion such that the connector does not experience corrosion and degradation during storage periods.

In another aspect, the electrical connector of the invention comprises tamper indication features that quickly and conveniently provide a visual indication of unauthorized tampering with the electrical connector.

In another aspect, the electrical connector of the invention comprises connecting and disconnecting features allowing the electrical connector to be repeatedly disassembled and reused without destroying the electrical connector or necessarily requiring the replacement of connector components.

The above summary of the various representative embodiments of the invention is not intended to describe each illustrated embodiment or every implementation of the invention. The figures in the detailed description that follow more particularly exemplify these embodiments

BRIEF DESCRIPTION OF THE DRAWINGS

The invention may be more completely understood in consideration of the following detailed description of various embodiments of the invention in connection with the accompanying drawings, in which.

Figure 1:
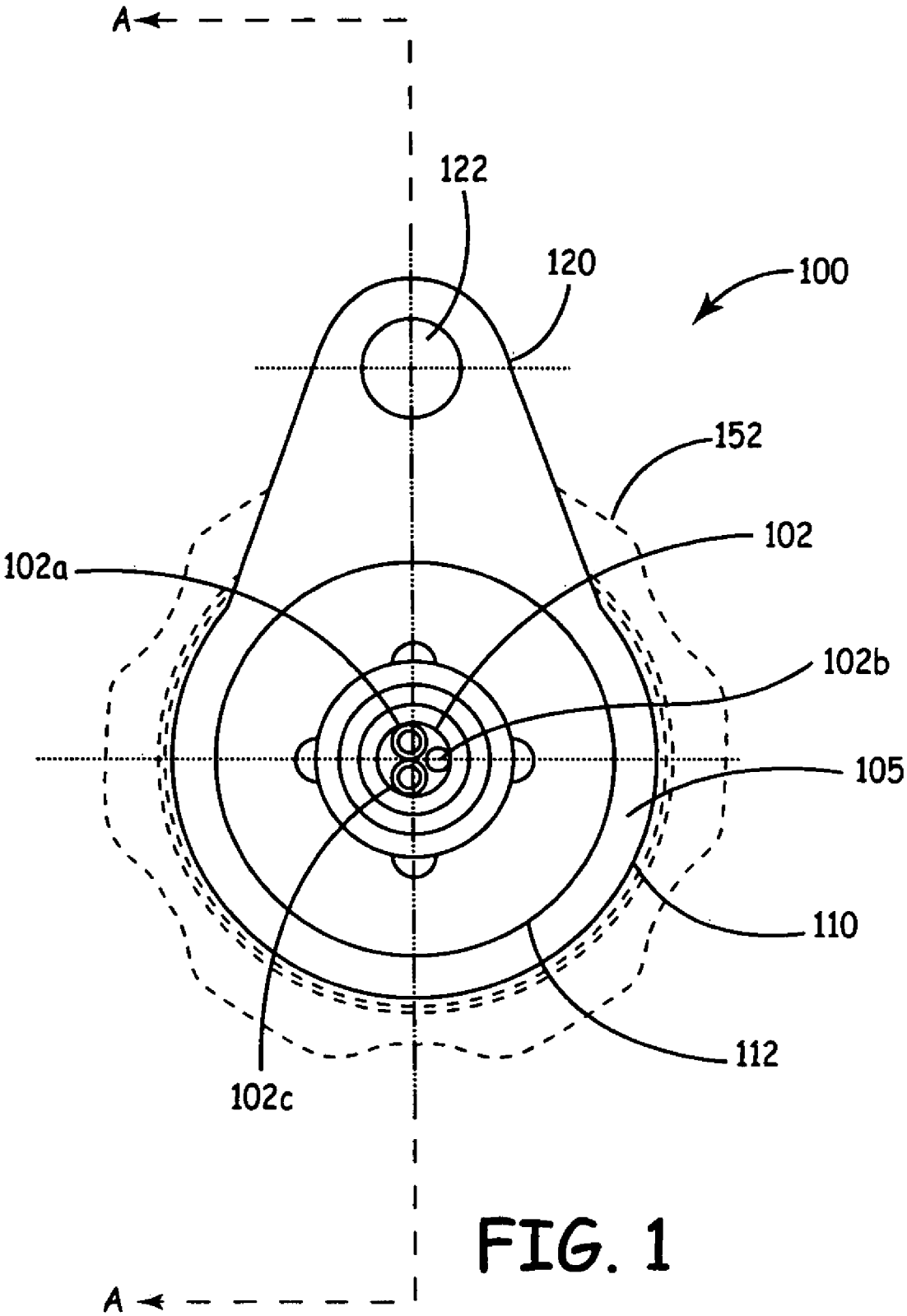
FIG. 1 is an end view of a completed electrical connection assembly utilizing an electrical connector of the invention.
Figure 2:
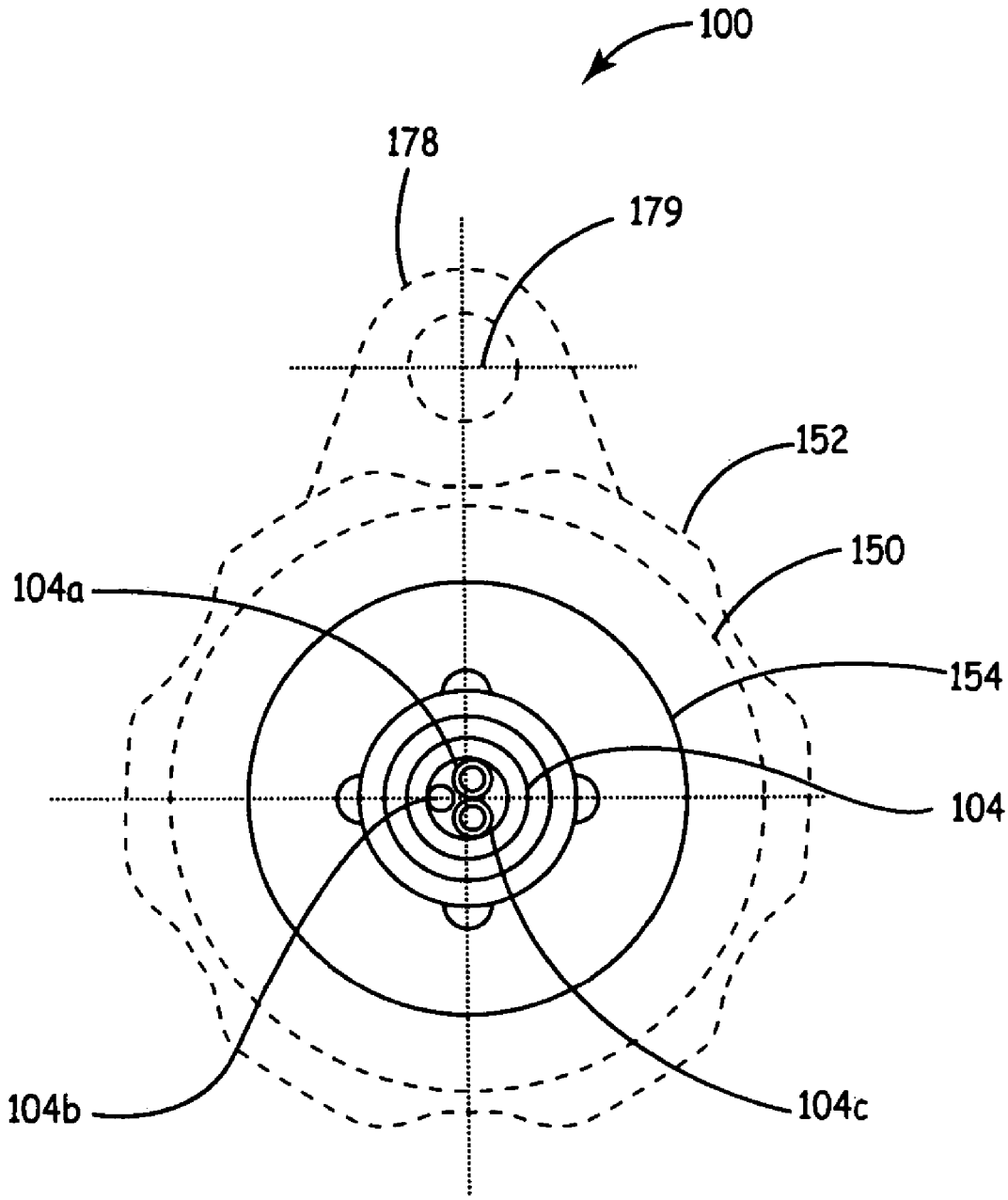
FIG. 2 is an end view of the electrical connection assembly of FIG. 1.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF PREFERRED EMBODIMENTS

The invention relates to electrical connectors adapted for use in a variety of environmental conditions. The electrical connector of the invention can be used reliably in a wide variety of environmental conditions including high ambient temperatures, freezing temperatures, low humidity and high humidity settings. Furthermore, the connector of the invention can be successfully utilized in situations in which the connector is exposed to water by splashing or even when completely submerged. Furthermore, the connector of the invention can be quickly installed without any special skills or tools.

Figure 3:
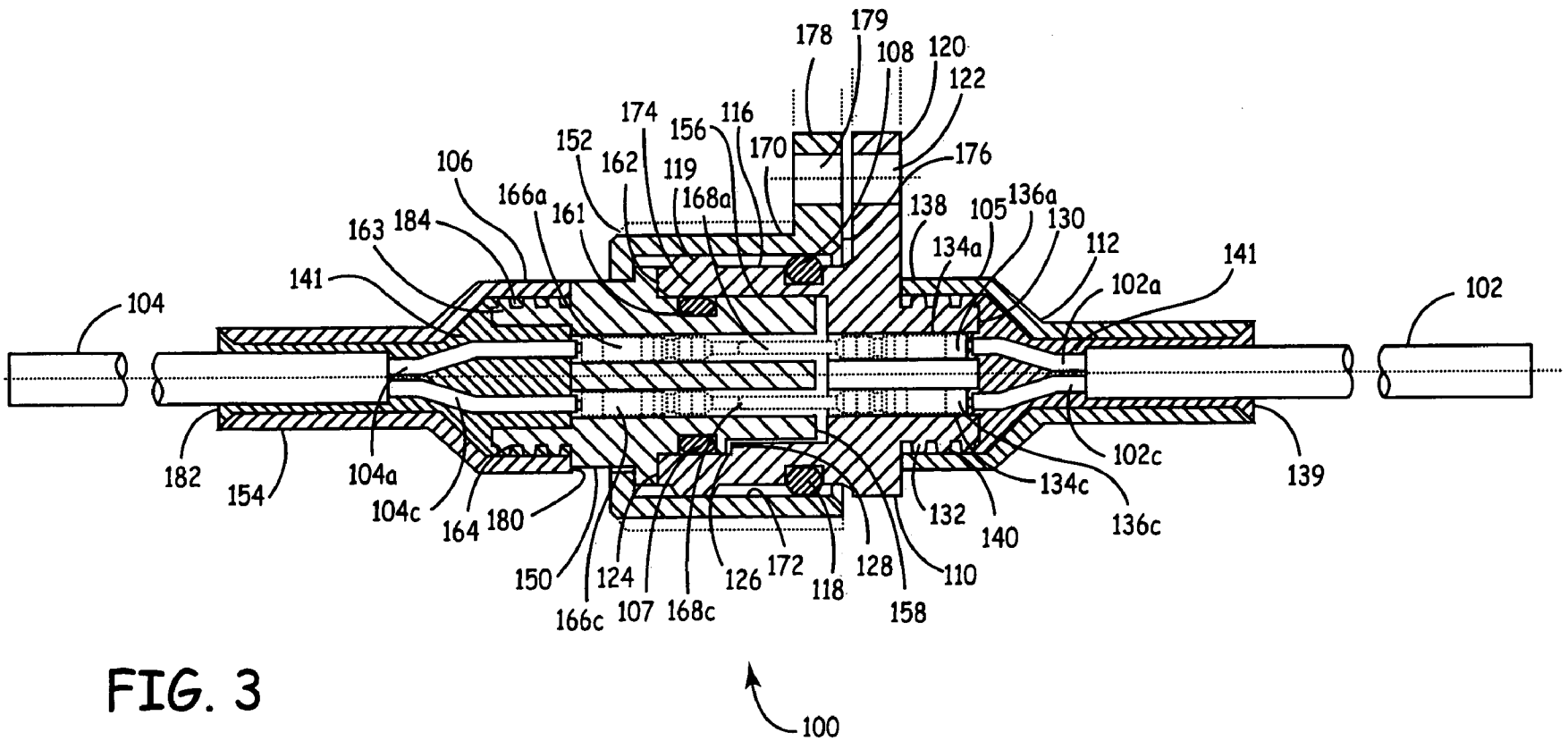
FIG. 3 is a section view of the electrical connection assembly of FIG. 1 taken along line A—A of FIG. 1.

A connector assembly 100 of the invention is depicted in FIGS. 1, 2, 3, 4, and 5. Generally, connector assembly 100 is used to electrically connect a first cable 102 with a second cable 104. The cables can be present in a variety of forms and will most typically include a plurality of individual wires encased within an exterior, protective casing. The cables can be supplied by any number of different manufactures, for example Belden. For purposes of describing the connector assembly 100 of the invention, first cable 102 is described as including a first wire 102*a*, a second wire 102*b*, and a third wire 102*c* while second cable 104 includes a first wire 104*a*, a second wire 104*b*, and a third wire 104*c*. As shown in FIG. 3, connector assembly 100 is comprised of a receptacle connector member 105, a plug connector member 106, a first radial seal 107, and a second radial seal 108. In one representative example, radial seals 107, 108 can comprise o-rings made of a resilient rubber or rubber-like, flexible polymer such as, for example, Ethylene Propylene Diene Monomer (EPDM), nitrile (Buna-N), silicone and fluorinated polymers and copolymers.

Figure 4:
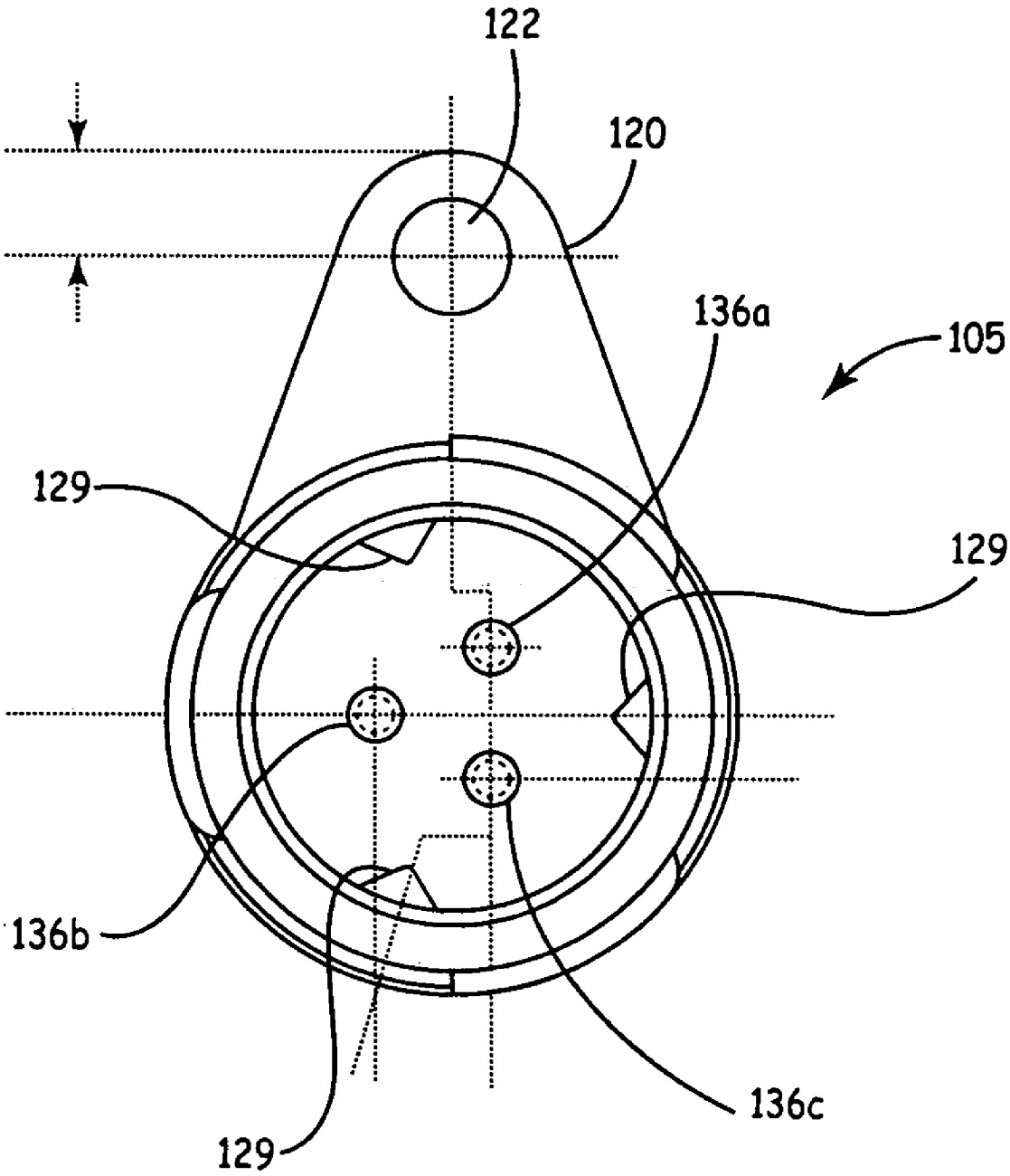
FIG. 4 is an end view of a receptacle connector member.

Receptacle connector member 105 comprises a receptacle connector body 110 and a receptacle backshell 112. Receptacle connector body 110 includes an outer wall 116 having an outer wall groove 118 and an outer wall thread 119. Outer wall groove 118 is dimensioned to accommodate second radial seal 108. Receptacle connector body 110 further comprises a receptacle locking tab 120 having a receptacle locking throughbore 122. Receptacle connector body 110 is further defined by a receptacle mating flange 124 and a receptacle inner wall 126 comprising an inner wall flange 128. Receptacle inner wall 126 includes a plurality of keyed projections 129 as shown in FIG. 4. Receptacle connector body 110 also includes a receptacle projecting end 130 including a perimeter receptacle thread 132. Receptacle connector body 110 includes three contact throughbores 134*a*, 134*b*, 134*c*, each throughbore including its own pin contact 136*a*, 136*b*, 136*c*. Pin contacts 136*a*, 136*b*, 136*c* are solid except for a blind hole used to connect first wire 102*a*, second wire 102*b* and third wire 102*c* such that liquid cannot wick up the wires to the pin contacts. Receptacle backshell 112 comprises a hollow member having a receptacle end 138 and a cable end 139. Receptacle end 138 includes an internal backshell thread 140. Receptacle end 138 is dimensioned to accommodate projecting end 130.

In assembling receptacle connector member 105, first wire 102*a*, second wire 102*b* and third wire 102*c* are attached to the pin contacts 136*a*, 136*b* and 136*c* through crimping or other suitable attachment method. First cable 102 can then be slid through receptacle backshell 112. Once first cable 102 is positioned through receptacle backshell 112, pin contacts 136*a*, 136*b*, 136*c* are press fit into contact throughbores 134*a*, 134*b* and 134*c*. Receptacle connector body 110 and receptacle backshell 112 are then threadably engaged using projection thread 132 and backshell thread 138. Epoxy potting 141 is then injected into receptacle backshell 112 such that no voids are formed, which could allow liquid/moisture to bridge between the wires 102*a*, 102*b*, 102*c*. As it cures, epoxy potting 141 adheres to first cable 102 and receptacle connector body 110. Epoxy potting 141 eliminates any leak path between the wires (102*a*, 102*b*, 102*c*) and pin contacts (136*a*, 136*b*, 136*c*) on the backside of receptacle connector body 110. Epoxy potting 141 also aids in increasing the tensile pull strength of connector assembly 100.

Figure 5:
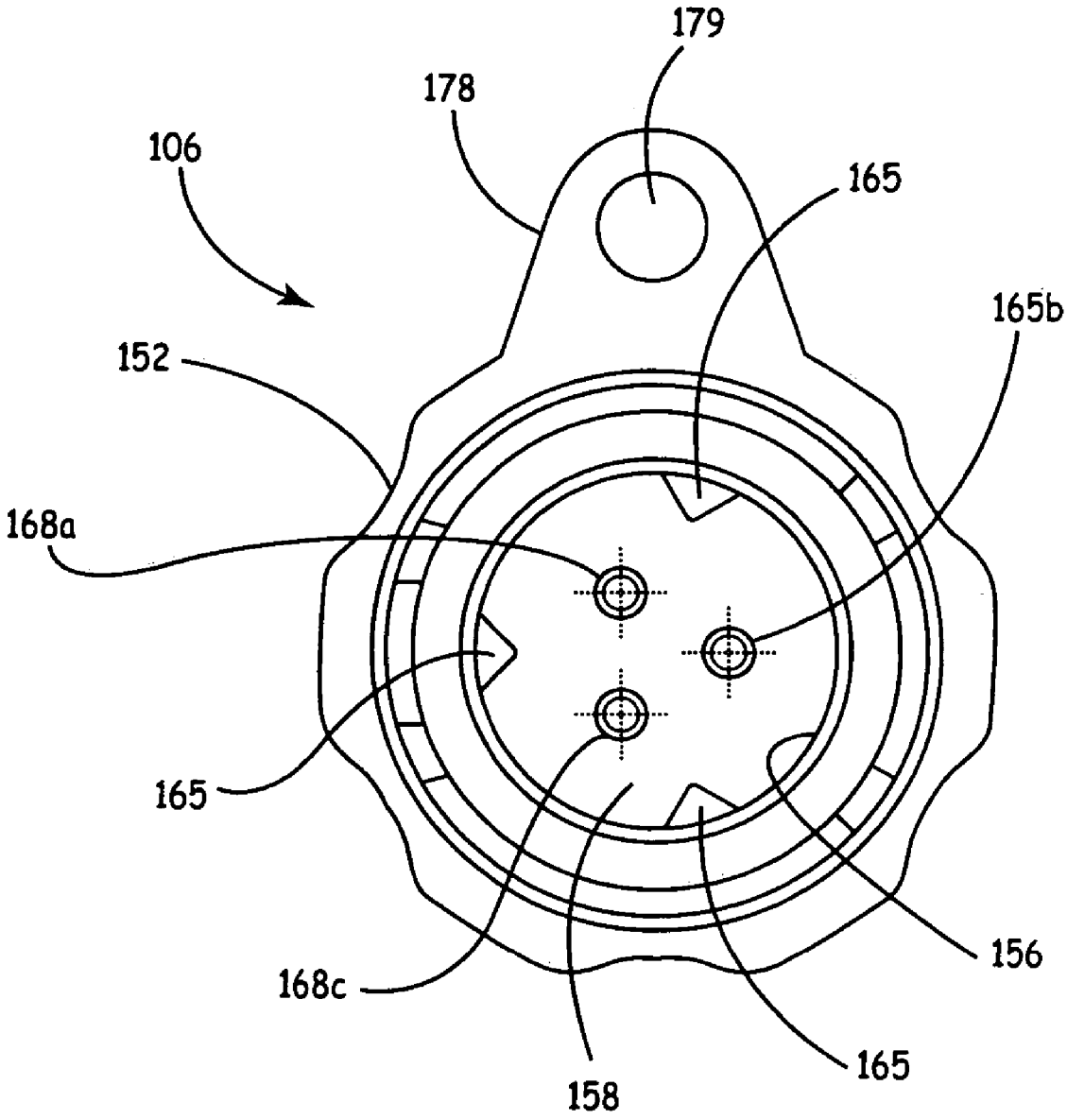
FIG. 5 is an end view of a plug connector member.

Referring again to FIGS. 1–5 and 6, plug connector member 106 is comprised of a plug connector body 150, a coupling nut 152 and a plug backshell 154. Plug connector body 150 is defined by a plug outer wall 156, a plug face 158 and a plug flange 162. Plug outer wall 156 includes an outer wall groove 161 and a plug projection 163 having a plug thread 164. Plug outerwall 156 further includes a plurality of keyed grooves 165 as shown in FIG. 5 corresponding to keyed projections 129. Plug connector body 150 includes three socket throughbores 166*a*, 166*b*, 166*c*, each throughbore including its own socket contact 168*a*, 168*b*, 168*c*. Socket contacts 168*a*, 168*b*, 168*c* are solid except for a blind hole used to connect first wire 104*a*, second wire 104*b* and third wire 104*c* such that liquid cannot wick up the wires to the socket contacts. Coupling nut 152 includes an outer nut surface 170 and an inner nut surface 172. Inner nut surface 172 includes an inner nut thread 174. Coupling nut 152 further comprises a nut locking tab 178 defining a nut locking face 176. Nut locking tab 178 includes a nut throughbore 179. Plug backshell 154 comprises a hollow member having a plug end 180 and a cable end 182. Plug end 180 includes an internal backshell thread 184. Plug end 180 is dimensioned to accommodate plug projection 163.

To assemble plug connector member 106, first wire 104*a*, second wire 104*b* and third wire 104*c* can be attached to the socket contacts 168*a*, 168*b* and 168*c* through crimping or other suitable attachment methods. Second cable 104 can then be slid through plug backshell 154. Once second cable 104 is positioned through plug backshell 154, socket contacts 168*a*, 168*b*, 168*c* are press fit into socket throughbores 166*a*, 166*b*, 166*c*. Plug connector body 150 and plug backshell 154 are then threadably engaged using plug thread 164 and backshell thread 184. Epoxy potting 141 is then injected into plug backshell 154 such that no voids are present, which could allow liquid/moisture to bridge between the wires 104*a*, 104*b*, 104*c*. As it cures, epoxy potting 141 adheres to second cable 104 and plug connector body 150. Epoxy potting 141 eliminates any leak path between the wires (104*a*, 104*b*, 104*c*) and socket contacts (168*a*, 168*b*, 168*c*) on the backside of plug connector body 150. Epoxy potting 141 also aids in increasing the tensile pull strength of the connector assembly 100.

After receptacle connector member 105 and plug connector member 106 are assembled, connector assembly 100 is assembled so a to facilitate electrical communication between first cable 102 and second cable 104. Second radial seal 108 is positioned within outer wall groove 118 while first radial seal 107 is positioned within outer wall groove 161. Receptacle connector member 105 and plug connector member 106 are approximated and aligned such that keyed projections 129 and keyed grooves 165 are in alignment. Preferably, keyed projections 129 and keyed grooves 165 are arranged so as to allow only a single possible orientation for connecting receptacle connector member 105 with plug connector member 106. Through the design and use of a single keying orientation, only a correctly aligned connection is possible, thus preventing the possibility of an unsuccessful or imperfect assembly of receptacle connector member 105 and plug connector member 106. Receptacle connector member 105 and plug connector member 106 are slidingly engaged such that keyed projections 129 engage the keyed grooves 165 prior to pin contacts 136*a*, 136*b*, 136*c* engaging their respective socket contact 168*a*, 168*b*, 168*c*. By aligning the keying features prior to the engagement of the contacts, the possibility of contact damage during alignment of the keying features is eliminated. Plug connector member 106 is inserted within receptacle connector member 105 such that plug flange 162 and inner wall flange 128 are in contact. The insertion of plug connector member 106 into receptacle connector member 105 causes radial compression of first radial seal 107 creating a watertight seal between plug connector member 106 and receptacle connector member 105.

Figure 6:
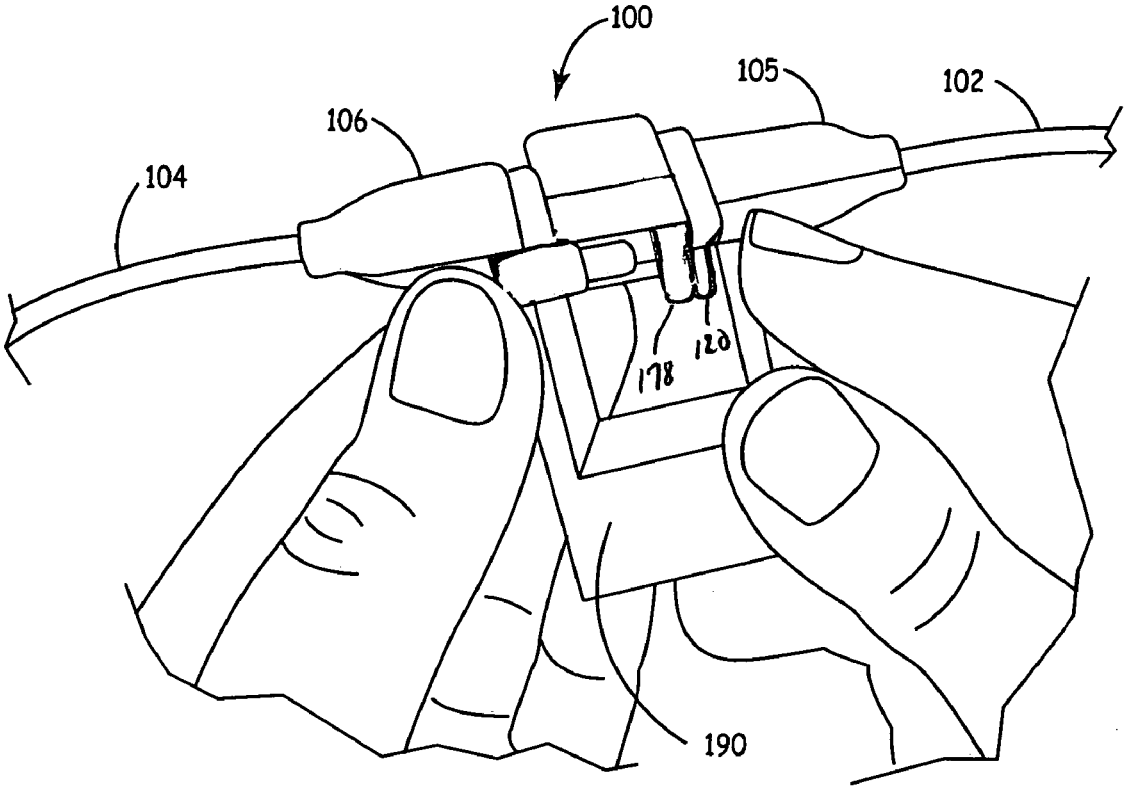
FIG. 6 is a side view of the electrical connection assembly of FIG. 1 including a security lock.

Next, coupling nut 152 is directed toward receptacle connector member 105 such that inner nut thread 174 threadably engages outer wall thread 119 . . . Coupling nut 152 is rotatably advanced to complete the mating of receptacle connector member 105 and plug connector member 106. As coupling nut 152 is rotatably advanced, second radial seal 108 is radially compressed creating a seal between coupling nut 152 and receptacle connector body 110. By rotating coupling nut 152 to radially compress second radial seal 108, the force required to compress both first radial seal 107 and second radial seal 108 is converted to a torque which is less than the axial force requirement if coupling nut 152 was merely pushed toward receptacle connector member 105. When compressed as described, second radial seal 108 prevents dirt and other miscellaneous debris from penetrating the connector assembly 100 such that operation of coupling nut 152 is not hindered following extended periods of field installation. Turning coupling nut 152 causes nut throughbore 179 to align with receptacle locking throughbore 122. The alignment of nut throughbore 179 with receptacle locking throughbore 122 provides a visual check to ensure that receptacle connector member 105 and plug connector member 106 are fully engaged. A security seal member 190, as shown in FIG. 6, is inserted through nut throughbore 179 and receptacle locking throughbore 122 to prevent tampering with installed connector assembly 100. While assembly of connector assembly 100 has been described, connector assembly 100 can be similarly disassembled by merely removing security seal member 190, rotatably uncoupling coupling nut 152 and pulling receptacle connector member 105 and plug connector member 106 apart if maintenance is necessary. This allows coupling nut 152, receptacle connector member 105 and plug connector member 106 to be reused without requiring a swap out of first cable 102 and second cable 104.

When fully assembled, connector assembly 100 of the invention includes a variety of sealing mechanisms to substantially eliminate the possibility of water/moisture intrusion as well as dirt and debris penetration. First radial seal 107 and second radial seal 108 provide dual radial seals with first radial seal 107 substantially eliminating any water leak potential at the contact interface while second radial seal 108 substantially prevents dirt and debris infiltration that could interfere with the operation of coupling nut 152. In addition, potting 141 within receptacle connector member 105 and plug connector member 106 provides a moisture impervious barrier to substantially eliminate water wicking up first cable 102 and second cable 104. Potting 141 serves a secondary purpose of substantially retaining the majority of the pull strength of first cable 102 and second cable 104 when connector assembly 100 is fully assembled.

Figure 7:
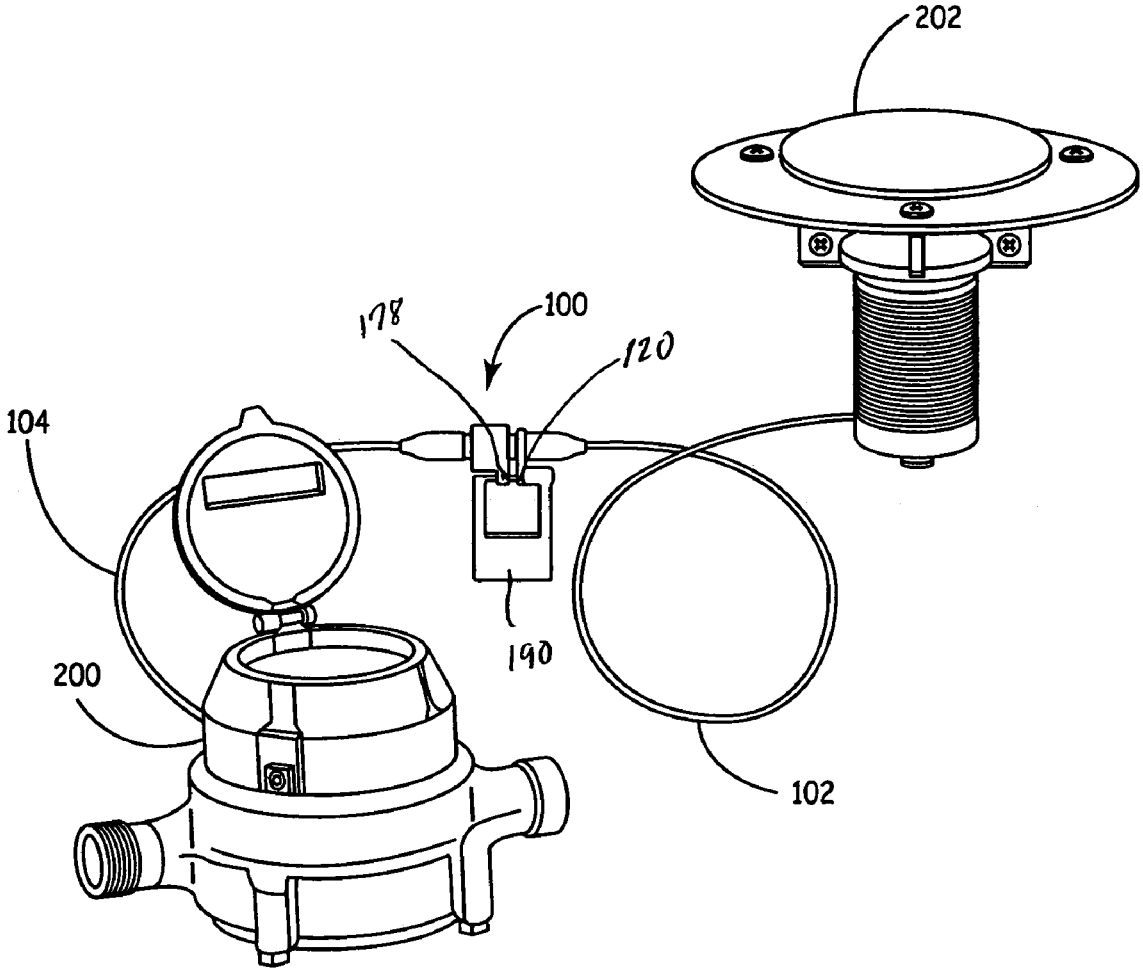
FIG. 7 is a pictorial representation of a typical water pit metering system.
Figure 8:
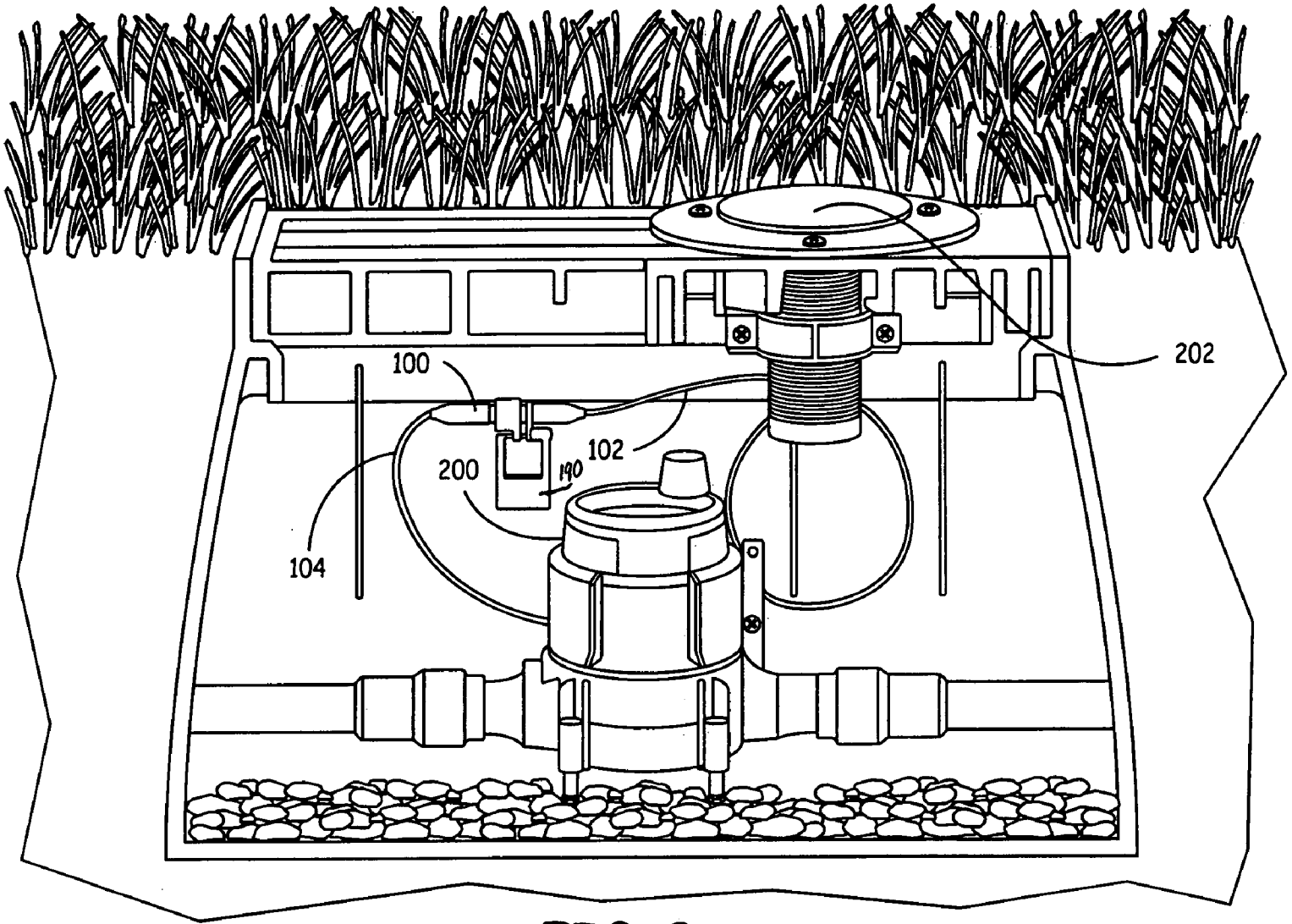
FIG. 8 is a section view of an example of a water pit installation.
Figure 9:
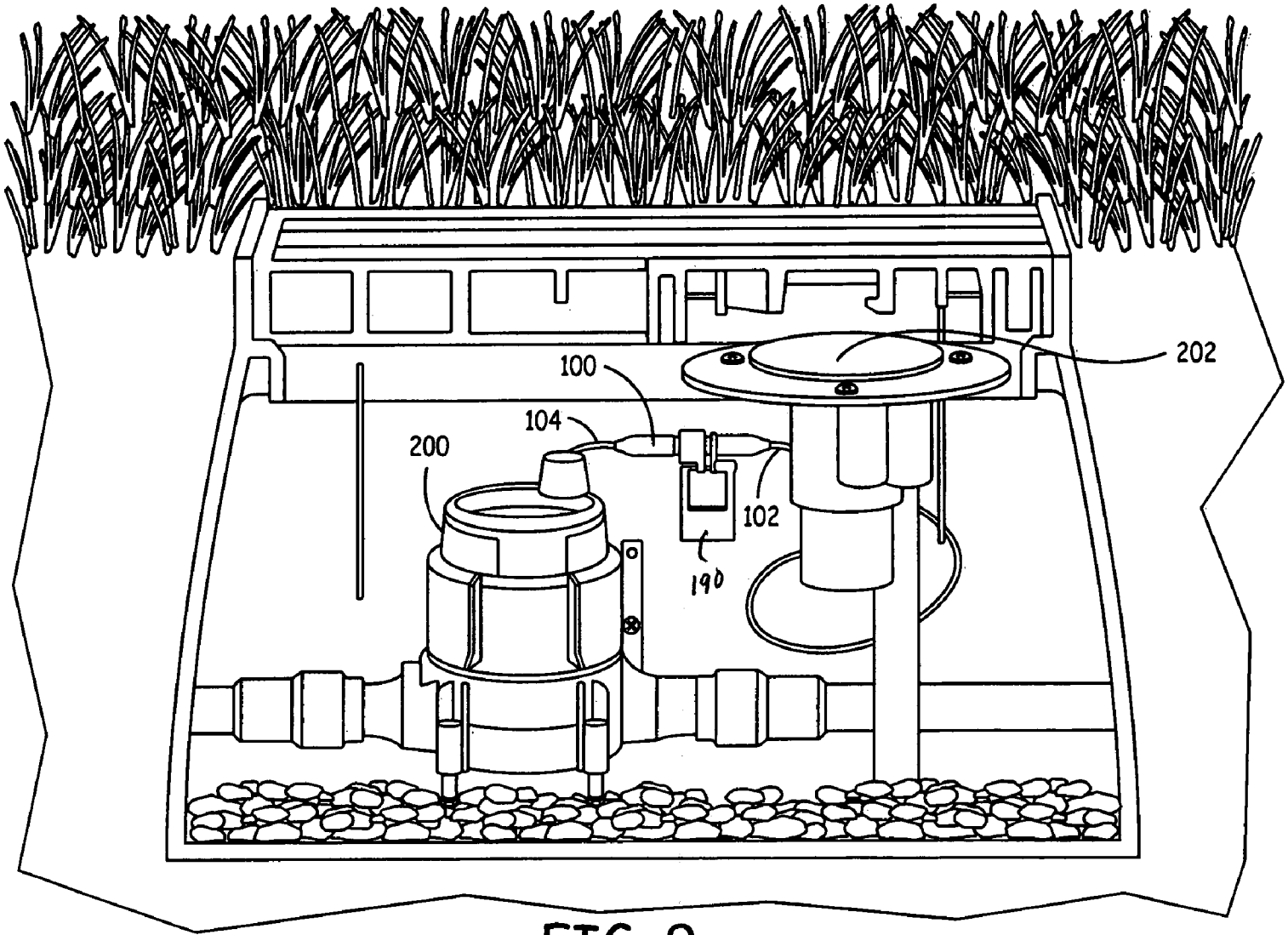
FIG. 9 is a section view of an example of a water pit installation.

Referring now to FIGS. 7, 8 and 9, there is illustrated one representative example application of connector assembly 100 of the invention. Connector assembly 100 depicted in this embodiment as connecting a water meter 200 with a transmitter 202 such as, for example, a radio frequency transmitter. As further depicted in FIGS. 8 and 9, water meter 200 can be located in a below ground water pit 204. Connector assembly 100 provides a dual radial seal to prevent moisture/water intrusion as well as dirt and debris infiltration that can cause other prior art connectors to fail. Transmitter 202 can be shipped from the factory with receptacle connector member 105 while water meter 200 can be installed with plug connector member 106. Connector assembly 100 allows for easy field installation as no special tools, strength, skills or dexterity are necessary to connect receptacle connector member 105 with plug connector member 106.

Figure 10:
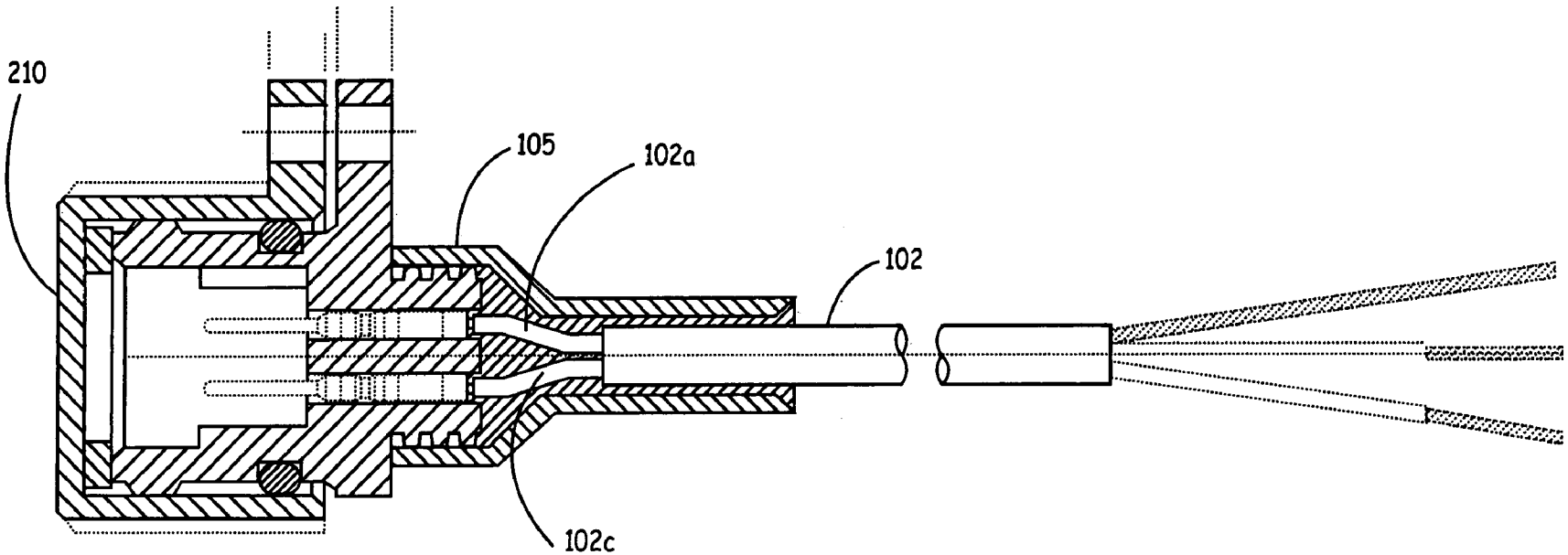
FIG. 10 is a section view of a receptacle connector member including a protective cap.
Figure 11:
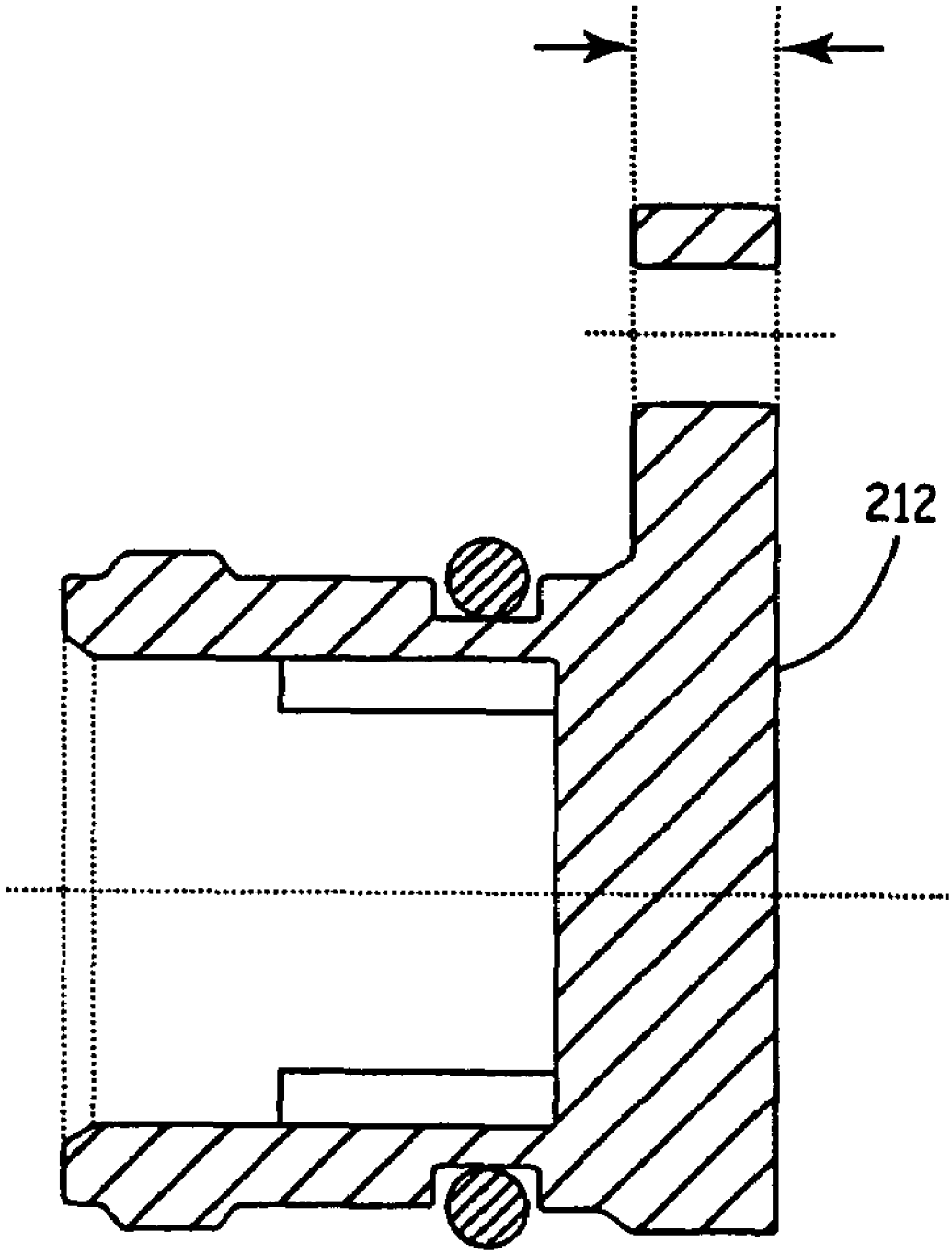
FIG. 11 is a section view of a protective cap for uses with a plug connector member.

As shown in a related embodiment in FIG. 10, receptacle connector member 105 can include a receptacle cover 210 to protect receptacle connector member 105 prior to installation while plug connector member 106 can include a plug cover 212 as shown in FIG. 11, to similarly protect plug connector member 106. The use of receptacle cover 210 and plug cover 212 allow both receptacle connector member 105 and plug connector member 106 to have an effective life of twenty years in one example embodiment. For example, receptacle connector member 105 and plug connector member 106 can be effectively stored prior to use for 15 years using receptacle cover 210 and plug cover 212 followed by the successful mating of receptacle connector member 105 and plug connector member 106 for another five years.

Although various embodiments of the invention have been disclosed here for purposes of illustration, it should be understood that a variety of changes, modifications and substitutions may be incorporated without departing from either the spirit or scope of the invention.

What is claimed:

1. An electrical connector comprising:

a plug member having a plurality of sealed plug contacts and a first radial seal;

a receptacle member having a plurality of sealed receptacle contacts, the receptacle member adapted to joiningly interface with the plug member such that the first radial seal compressingly engages an inner wall of said receptacle member to form a first contaminant barrier and wherein the plug contacts and receptacle contacts are electrically interfaced; and a coupling nut adapted to shroudingly retain the plug member and rotatably attach to the receptacle member, the coupling nut engaging the receptacle member such that a second radial seal on the receptacle member is compressed at a coupling surface on the coupling nut so as to form a second contaminant barrier and wherein the coupling nut is rotatably detachable from the receptacle member, wherein the coupling nut further comprises a coupling bore and the receptacle member further comprises a receptacle bore, said coupling bore and receptacle bore being substantially aligned when the coupling nut is fully engaged with the receptacle member such that a security seal member can be operably secured through the aligned coupling bore and receptacle bore.

2. The electrical connector of claim 1, wherein the first radial seal and the second radial seal each comprise an o-ring member.

3. The electrical connector of claim 1, wherein the first radial seal and the second radial seal are manufactured of a polymer comprising a resilient rubber or rubber-like, flexible polymer wherein the flexible polymer an comprise EPDM, Buna-N, silicone and fluorinated polymers and copolymers.

4. The electrical connector of claim 1, wherein the plug member includes a plug key and the receptacle member includes a receptacle key, wherein the plug key and the receptacle key cooperatively promote joining of the plug member and the receptacle member in a single aligned orientation.

5. The electrical connector of claim 1 wherein the security seal is adapted to be permanently secured such that disengagement of the coupling nut and the receptacle member necessitates removal of the security seal.

6. The electrical connector of claim 5 wherein removal of the security seal provides a tampering indication.

7. The electrical connector of claim 1 wherein the plug member further comprises a first cable operably connected to the sealed plug contacts and wherein the receptacle member further comprises a second cable operably connected to the sealed receptacle contacts wherein connection of the plug member to the receptacle member electrically interconnects the first cable with the second cable.

8. The electrical connector of claim 7 wherein the first cable is potted to the plug member and the second cable is potted to the receptacle member such that the combination of the potting, the interconnection of the socket connectors with the pin connectors and the engagement of the plug member, the receptacle member and the coupling nut provides an electrical circuit pull strength of at least 75% of both a first cable initial pull strength and a second cable initial pull strength.

9. A method for effecting an electrical connection in a harsh environment comprising:

connecting a plug member having a set of plug contacts and a receptacle member having a set of receptacle contacts such that the plug contacts and receptacle contacts are electrically interfaced, the plug member compressing a first radial seal member against a receptacle inner wall such that a first containment barrier is formed;

advancing a coupling nut over the plug member such that the plug member is shroudingly engaged by the coupling nut;

engaging the coupling nut with the receptacle member, the coupling nut rotatably interfacing with the receptacle member such that a second radial seal on the receptacle member is compressingly engaged by a coupling surface so as to form a second containment barrier; and locking the coupling nut to the receptacle member with a security seal member, the security seal member adapted to be inserted through a nut throughbore and a receptacle throughbore, the nut throughbore and receptacle throughbore being substantially aligned when the second containment barrier is formed.

10. The method of claim 9 further comprising:

indicating a circuit tampering condition upon attempted removal of the security seal member.

11. The method of claim 9 further comprising:

completing an electrical connection between a first wire and a second wire, the first wire electrically interconnected to the plug contacts and the second wire being electrically interconnected to the receptacle contacts.

12. The method of claim 9 further comprising:

fitting an o-ring member over each of the plug member and the receptacle member before connecting the plug member and receptacle member.

13. The method of claim 9, wherein the first radial seal and the second radial seal are manufactured of a polymer comprising a resilient rubber or rubber-like, flexible polymer wherein the flexible polymer an comprise EPDM, Buna-N, silicone and fluorinated polymers and copolymers.

14. The method of claim 9 further comprising:

aligning the plug member and the receptacle member such that a plug key and a receptacle key cooperatively define a single aligned orientation for engagement of the plug member and the receptacle member.

* * * * *

UNITED STATES PATENT AND TRADEMARK OFFICE

CERTIFICATE OF CORRECTION

PATENT NO. : 7,033,193 B2
APPLICATION NO. : 11/007657
DATED : April 25, 2006
INVENTOR(S) : Sidney A. Higgins et al.

It is certified that error appears in the above-identified patent and that said Letters Patent is hereby corrected as shown below:

Column 5, line 17, please delete “a” and insert “as”.
Column 5, line 48, please delete “. .”.
Column 7, line 33, please delete “an”.
Column 8, line 47, please delete “an”.

Signed and Sealed this

Fifteenth Day of April, 2008

JON W. DUDAS
*Director of the United States Patent and Trademark Office*